US012402762B2

(12) United States Patent
Duetsch et al.

(10) Patent No.: US 12,402,762 B2
(45) Date of Patent: Sep. 2, 2025

(54) TOILET BRUSH WITH CHANGEABLE BRUSH HEAD

(71) Applicant: Cre-A-Solve AG, Wil (CH)

(72) Inventors: Andreas Duetsch, Lenggenwil (CH); Silvan Bruhin, Uznach (CH); Thomas Duss, Altendorf (CH)

(73) Assignee: Cre-A-Solve AG, Wallenwil (CH)

( * ) Notice: Subject to any disclaimer, the term of this patent is extended or adjusted under 35 U.S.C. 154(b) by 1087 days.

(21) Appl. No.: 17/295,498

(22) PCT Filed: Nov. 19, 2019

(86) PCT No.: PCT/EP2019/081819

§ 371 (c)(1),
(2) Date: May 20, 2021

(87) PCT Pub. No.: WO2020/104466

PCT Pub. Date: May 28, 2020

(65) Prior Publication Data

US 2022/0000324 A1 Jan. 6, 2022

(30) Foreign Application Priority Data

Nov. 21, 2018 (EP) ..... 18207650

(51) Int. Cl.
*A47K 11/10* (2006.01)
*A46B 5/00* (2006.01)

(52) U.S. Cl.
CPC ..... *A47K 11/10* (2013.01); *A46B 5/0095* (2013.01); *A46B 2200/304* (2013.01)

(58) Field of Classification Search
CPC . A46B 2200/304; A46B 5/0095; A47K 11/10; B25G 3/16
See application file for complete search history.

(56) References Cited

U.S. PATENT DOCUMENTS 4,457,038 A 7/1984 Hammond
6,230,357 B1 * 5/2001 Davis ..... A46B 7/04 15/176.3

(Continued)

FOREIGN PATENT DOCUMENTS

CA 2277705 A1 7/2000
CN 201119852 Y 9/2008

(Continued)

OTHER PUBLICATIONS

English translation of DE 202017104830 U1, Avenarius, Sep. 20, 2017. (Year: 2017).*

*Primary Examiner* — Laura C Guidotti
(74) *Attorney, Agent, or Firm* — The Webb Law Firm

(57) ABSTRACT

A toilet brush for cleaning a toilet bowl includes a handle having a connection structure and a brush head having a connection structure being configured complementary to the connection structure of the handle. The brush head and the handle can be releasably connected with each other by means of their respective connection structure. The handle further includes at least one guide structure and the brush head further includes at least one guide structure being configured complementary to the at least one guide structure of the handle, such that the brush head and the handle can be connected to one another and disconnected from one another in a guided manner.

20 Claims, 8 Drawing Sheets

(56) References Cited

U.S. PATENT DOCUMENTS

| | | | | |
|---|---|---|---|---|
| 7,530,138 | B1 | 5/2009 | Platt | |
| 7,900,287 | B2 * | 3/2011 | Wildauer | E03C 1/308 4/255.11 |
| 2004/0010877 | A1 * | 1/2004 | Jackson | A46B 7/04 15/210.1 |
| 2004/0129296 | A1 | 7/2004 | Treacy et al. | |
| 2005/0204499 | A1 | 9/2005 | Jackson | |
| 2007/0151059 | A1 | 7/2007 | Petner et al. | |
| 2009/0249572 | A1 * | 10/2009 | Minkler | A47L 13/46 15/210.1 |
| 2012/0011643 | A1 | 1/2012 | Schultz | |

FOREIGN PATENT DOCUMENTS

| | | | | |
|---|---|---|---|---|
| CN | 101756500 | A | 6/2010 | |
| CN | 102138767 | A | 8/2011 | |
| CN | 203597863 | U | 5/2014 | |
| CN | 104116467 | A | 10/2014 | |
| CN | 105686768 | A | 6/2016 | |
| CN | 107736841 | A | 2/2018 | |
| CN | 207118863 | U | 3/2018 | |
| DE | 202013101982 | U1 * | 6/2013 | A47K 11/10 |
| DE | 202017104830 | U1 * | 9/2017 | A47K 11/10 |
| GB | 2502854 | A | 12/2013 | |
| JP | H0294698 | U | 7/1990 | |
| TW | 459520 | | 10/2001 | |

* cited by examiner

TOILET BRUSH WITH CHANGEABLE BRUSH HEAD

CROSS-REFERENCE TO RELATED APPLICATIONS

This application is the United States national phase of International Application No. PCT/EP2019/081819 filed Nov. 19, 2019, and claims priority to European Patent Application No. 18207650.5 filed Nov. 21, 2018, the disclosures of which are hereby incorporated by reference in their entirety.

BACKGROUND OF THE INVENTION

Field of the Invention

The present invention relates to a toilet brush for cleaning a toilet bowl.

Description of Related Art

Toilet brushes with exchangeable brush heads are well-known in the art. These types of brushes allow a brush head that has become dirty over time to be replaced by a new, clean brush head. In this case the handle of the toile brush can be re-used, which is material- and resource-saving. In addition, a re-usable handle can be manufactured from more valuable and thus aesthetically more appealing materials than entirely disposable toilet brushes.

It is a general desire that a used brush head should not have to be touched. For example, DE 20 2013 101 982 U1 discloses a toilet brush comprising a handle and a brush head with an adapter that can be triggered by means of an actuator button. An actuation of the actuator button axially displaces a rod, whereby a latching connection between the adapter and the handle is released.

A released connection has the effect that the brush head is released from the handle. At the same time however there is the possibility that the released brush head falls down in any way and does not land at the desired location, in the waste bin, for example.

SUMMARY OF THE INVENTION

It is an object of the present invention to provide a toilet brush that allows an exchange of a brush head in a simple and reliable manner.

In particular, a toilet brush for cleaning a toilet bowl is provided, which comprises a handle extending along a longitudinal axis and having a connection structure, and a brush head having a center axis and having a connection structure being configured complementary to the connection structure of the handle, wherein the brush head and the handle can be releasably connected with each other by means of their respective connection structure. The handle further comprises at least one guide structure and the brush head further comprises at least one guide structure being configured complementary to the at least one guide structure of the handle, such that the brush head and the handle can be connected to one another and disconnected from one another in a guided manner.

That is to say, the complementary connection structures provide a releasable connection between the brush head and the handle and the complementary guide structures enable a guided connection of the brush head with the handle and disconnection of the brush head from the handle.

The connection structure of the handle and the connection structure of the brush head can establish, in a connected state, a rotary connection or a plug-in rotary connection, in particular a threaded connection or a bayonet connection. For example, the connection structure of the brush head can correspond to an outer (inner) thread that can be brought into engagement with a corresponding inner (outer) thread of the handle. It is likewise conceivable that the connection structure of the brush head corresponds to a protrusion that can be plugged into a first part of a recess and can then be turned into a second part of the recess of the handle and vice versa. Compared to a plug-in connection or latching connection these connections have the advantage that an unintentional release caused by the cleaning movement of the toilet brush is prevented or at least reduced. In the case of a bayonet connection guidance during the connection and disconnection of the brush head from the handle is already provided by the bayonet coupling per se. That is, the first part of the recess and the protrusion that is plugged into said first part of the recess can be seen as linear guide structures.

The connection structure of the handle can be designed to be rotatable about the longitudinal axis of the handle and to be non-displaceable along said longitudinal axis, or the connection structure of the handle can be designed to be non-rotatable about the longitudinal axis of the handle and to be non-displaceable along said longitudinal axis.

That is, it is conceivable that the connection structure of the handle, for example the thread or bayonet structure mentioned above, is designed such that it can be rotated and brought out of engagement with the corresponding connection structure of the brush head. In this case, the brush head need not to be rotated during the disconnection. In other words, the connection structure of the handle can be arranged on the handle so as to be rotatable about the longitudinal axis of the handle and so as to be non-displaceable along said longitudinal axis. However, it is likewise possible that the connection structure of the handle is designed such that it is brought out of the engagement with the corresponding connection structure of the brush head without having to be rotated. In this case, the rotational movement is performed by the brush head. In other words, the connection structure of the handle can be arranged on the handle so as to be non-rotatable about the longitudinal axis of the handle and so as to be non-displaceable along said longitudinal axis. In any case it is preferred that the connection structure of the handle is configured non-displaceable along the longitudinal axis.

The connection structure of the brush head can be designed to be non-rotatable about the center axis of the brush head and to be non-displaceable along said center axis, said connection structure and the brush head being preferably formed in one piece. In other words, it is preferred that the connection structure, for example the thread or bayonet structure, is fixedly connected to the brush head. In doing so the connection structure of the brush head is arranged so as to be non-rotatable about the center axis of the brush head and non-displaceable along said center axis.

The at least one guide structure of the handle can be designed to be rotatable about the longitudinal axis of the handle and to be non-displaceable along said longitudinal axis or the at least one guide structure of the handle can be designed to be non-rotatable about the longitudinal axis of the handle and to be non-displaceable along said longitudinal axis.

In other words, the at least one guide structure of the handle can be arranged on the handle so as to be rotatable about the longitudinal axis of the handle and to be non-displaceable along said longitudinal axis or the at least one guide structure of the handle can be arranged on the handle so as to be non-rotatable about the longitudinal axis of the handle and to be non-displaceable along said longitudinal axis. If the handle comprises a connection structure that is non-rotatable about the longitudinal axis of the handle, it is preferred that the handle comprises a guide structure that is rotatable about said axis. On the other hand, if the handle comprises a connection structure that is rotatable about the longitudinal axis of the handle, it is preferred that the connection structure is non-rotatable about said axis.

The at least one guide structure of the brush head can be designed to be non-rotatable about the center axis of the brush head and to be non-displaceable along said center axis, said at least one guide structure and the brush head being preferably formed in one piece. In other words, it is preferred that the guide structure is fixedly connected to the brush head or forms an integral part of the brush head. In doing so the at least one guide structure of the brush head is arranged so as to be non-rotatable about the center axis of the brush head and to be non-displaceable along said center axis.

The at least one guide structure and the connection structure of the handle can be arranged axially offset relative to each other with respect to the longitudinal axis of the handle and/or the at least one guide structure and the connection structure of the brush head can be arranged axially offset relative to each other with respect to the center axis of the brush head.

The at least one guide structure and the connection structure of the handle can be arranged radially spaced apart from one another with respect to the longitudinal axis of the handle and/or the at least one guide structure and the connection structure of the brush head can be arranged radially spaced apart from one another with respect to the center axis of the brush head.

In this context it should be understood that a radial spacing and/or axial spacing of the guide structure and the connection structure of the handle should be present on the brush head in an analogous manner so as to ensure a guidance and connection between the brush head and the handle or disconnection of the brush head from the handle. For example, if the guide structure (connection structure) of the handle is radially spaced apart from the connection structure (guide structure) of the handle, then the guide structure (connection structure) of the brush head is also radially spaced apart from the connection structure (guide structure) of the brush head.

It is preferred that the guide structure of the handle and the connection structure of the handle are separate components. It is particularly preferred that the guide structure of the handle and the connection structure of the handle are separate components being arranged at a radial and axial distance from one another. Similarly, it is particularly preferred that the guide structure of the brush head and the connection structure of the brush head are arranged at a radial and axial distance from one another.

It is preferred that the at least one guide structures of the handle and the brush head are configured such, that upon the connection of the brush head and the handle, a connection between the at least one guide structures of the handle and the brush head is established prior to a connection being established between the connection structures of the handle and the brush head, and that upon the detachment of the brush head from the handle, the connection established between the at least one guide structures of the handle and the brush head is released after the connection established between the connection structures of the handle and the brush head is released.

Hence, a connection of a brush head to the handle could take place as follows: In a first step, the brush head and the handle are moved towards one another in a linear movement, wherein the guide structure of the handle and the guide structure of the brush head come into contact with each other, wherein no contact is established between the connection structures of the handle and the brush head. In a second step, the brush head and the handle are further linearly moved towards one another until their connection structures establish a contact. Then, in a third step, the connection structures are brought into engagement with each other, during which the contact established between the guide structures is maintained.

Moreover, a disconnection of a brush head from the handle could take place as follows: In a first step, the connection structures are brought out of engagement with each other, during which the contact established between the guide structures is maintained. In a second step, the brush head and the handle are moved linearly away from one another until their connection structures are completely out of contact. Then, in a third step, the brush head and the handle are further moved away from one another in a linear movement, wherein the guide structure of the handle and the guide structure of the brush head get out of contact with each other. Thus, at least to a certain extent the guide structures fulfill a dual function, namely a centering and guidance. The centering minimizes the risk of an unintended tilting of the brush head relative to the handle, which enables an easier and more stable connection.

Hence, it is preferred that the guide structure of the handle has a protruding design when seen along the longitudinal axis and which can be received in a corresponding recess provided on the brush head. However, it is likewise conceivable that the brush head has a guide structure of a protruding design when seen along the center axis and which can be received in a corresponding recess provided on the handle. For example, the guide structure of the handle can have the form of one or more elongate slots into which the guide structure of the brush head in the form of one or more elongate ribs are received (and vice versa). It should be noted that the design is not restricted to slots and ribs. Instead, any other design that allows a guided receiving is conceivable, such as a plug and socket, for example.

The at least one guide structure of the handle and the at least one guide structure of the brush head can establish, in a connected state, a form-fit and/or a force-fit. For example, and as already outlined above, the guide structure of the handle or of the brush head, respectively, can be designed as a protrusion, which engages with the at least one guide structure of the brush head or the handle, respectively, being designed as a corresponding recess. Other possible designs are a plug such as a screw head that can be arranged within a corresponding socket.

The handle can comprise a housing, and wherein the connection structure of the handle is arranged preferably entirely within the housing and/or wherein the at least one guide structure of the handle forms part of the housing. Or, the handle can comprise a housing, and wherein the connection structure of the handle can form part of the housing and/or wherein the at least one guide structure is arranged preferably entirely within the housing.

Hence, it is preferred that the handle comprises a housing. In a first aspect, the connection structure of the handle can be arranged at least partially, preferably entirely within the housing, wherein the at least one guide structure forms part, preferably an integral part, of the housing. In a second aspect, the connection structure of the handle can form part of the housing, preferably an integral part of the housing, and the at least one guide structure is arranged at least partially, preferably entirely within the housing. Again it is not required that the guide structure or the connection structure forms an integral part of the housing, respectively. Instead, depending on the design of the guide structure it is likewise conceivable to attach or fix it in a manner known in the art to the housing, for example by gluing.

The toilet brush preferably further comprises a rotary element which is rotatably mounted on the handle, wherein a rotation of the rotary element about the longitudinal axis of the handle results in a rotation of the at least one guide structure of the handle, or wherein a rotation of the rotary element about the longitudinal axis of the handle results in a rotation of the connection structure of the handle.

Hence, with reference to the above first aspect it is preferred that the connection structure and the rotary element are designed and arranged such that a rotation of the rotary element about the handle, in particular about the housing of the handle, results in a rotation of the connection structure of the handle. In the case of the above-mentioned rotary connection or plug-in rotary connection established between the brush head and the handle in the connected state, a rotation of the connection structure successively releases the connection between the connection structures of the handle and the brush head. With reference to the above second aspect it is preferred that the at least one guide structure of the handle and the rotary element are designed and arranged such, that a rotation of the rotary element with respect to the handle results in a rotation of the at least one guide structure. In the case of the above-mentioned rotary connection or plug-in rotary connection established between the brush head and the handle in the connected state, a rotation of the guide structure of the brush head successively and in a way indirectly releases the connection between the connection structures of the handle and the brush head.

That is, in any case it is preferred that the rotary element is designed and arranged such that a rotation of the rotary element results in a release of the connection between the brush head and the handle. Moreover, in both cases, after the connection between the connection structures is released, the guide structures enable a guided disconnection of the brush head from the handle by means of gravitation only, wherein the guide structure of the brush head successively slides out of contact with the guide structure of the handle in the event that the toilet brush is held in a downward direction with the brush head being oriented downwards. The rotary motion applied by means of the rotary element therefore results in a disconnection of the connection as well as in a guided release of the brush head from the handle.

The rotary element and the connection structure of the handle can be arranged axially offset relative to each other with respect to the longitudinal axis of the handle and/or the rotary element and the at least one guide structure of the handle can be arranged axially offset relative to each other with respect to the longitudinal axis of the handle, and/or the rotary element and the connection structure of the handle can be arranged radially spaced apart from one another with respect to the longitudinal axis of the handle and/or the rotary element and the at least one guide structure of the handle can be arranged radially spaced from one another with respect to the longitudinal axis of the handle.

For example, with regard to the first aspect it is preferred that the guide structure in the form of the slot and the rotary element as well as the connection structure in the form of the bayonet and the rotary element of the handle are in each case arranged axially spaced apart from each other when seen along the longitudinal axis of the handle. Additionally, it is preferred that the rotary element is arranged at a radial distance from the connection structure with respect to the longitudinal axis of the handle. With regard to the second aspect it is preferred that the guide structure in the form of the socket and the rotary element as well as the connection structure in the form of an inner thread and the rotary element of the handle are in each case arranged axially spaced apart from each other when seen along the longitudinal axis of the handle. Additionally, it is preferred that the rotary element and the guide structure and the connection structure are arranged essentially on a same axis when viewed along the longitudinal axis of the handle.

The rotary element and the connection structure of the handle and/or the at least one guide structure of the handle can be designed as separate components and which separate components are fastened to one another by means of a corresponding fastening structure, or the rotary element and the connection structure of the handle and/or the at least one guide structure of the handle can be designed as a single-piece component.

For example, with respect to the first aspect it is preferred that the rotary element, the connection structure and the guide structure of the handle are in each case separate components. With regard to the second aspect however it is preferred that the rotary element and the guide structure are designed as a single-piece component, i.e. formed in one piece, whereas the rotary element and the connection structure are provided as separate components.

The rotary element can be mounted on an outside of the handle and can be in connection with the connection structure of the handle and/or with the at least one guide structure of the handle arranged in an interior of the handle or with the connection structure of the handle arranged in the interior of the handle.

Regarding the first aspect it is for example conceivable to design and arrange the rotary element such, that it can be mounted on an outside of the handle, in particular on an outside of the handle housing, wherein said rotary element is graspable by a user and is in connection with the connection structure arranged within the handle. To this end it is preferred to design the rotary element as a clip that at least partially surrounds the handle housing and which clip is in connection with the connection structure arranged within the housing, for example via an opening or recess provided in the housing, such that a rotation of the rotary element about the longitudinal axis of the handle is transferred to the connection structure. In order to transfer a rotary motion of the rotary element to the connection structure it is necessary that these components are in operative connection with each other. For instance, the rotary element and the connection structure can be provided as a single-piece element or the rotary element and the connection structure can be connected by corresponding fastening structures such as a latching connection.

Regarding the second aspect it is for example conceivable to design and arrange the rotary element and the guide structure as a single-piece element, wherein the guide structure is arranged preferably entirely within the handle housing and the rotary element is at least partially protruding from the handle housing such that it is graspable by a user. In any case it is preferred that the rotary element is arranged rotatable about the longitudinal axis of the handle but not axially displaceable with respect to the longitudinal axis of the handle, in particular immovable with regard to the handle housing.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF THE INVENTION

Figure 1:
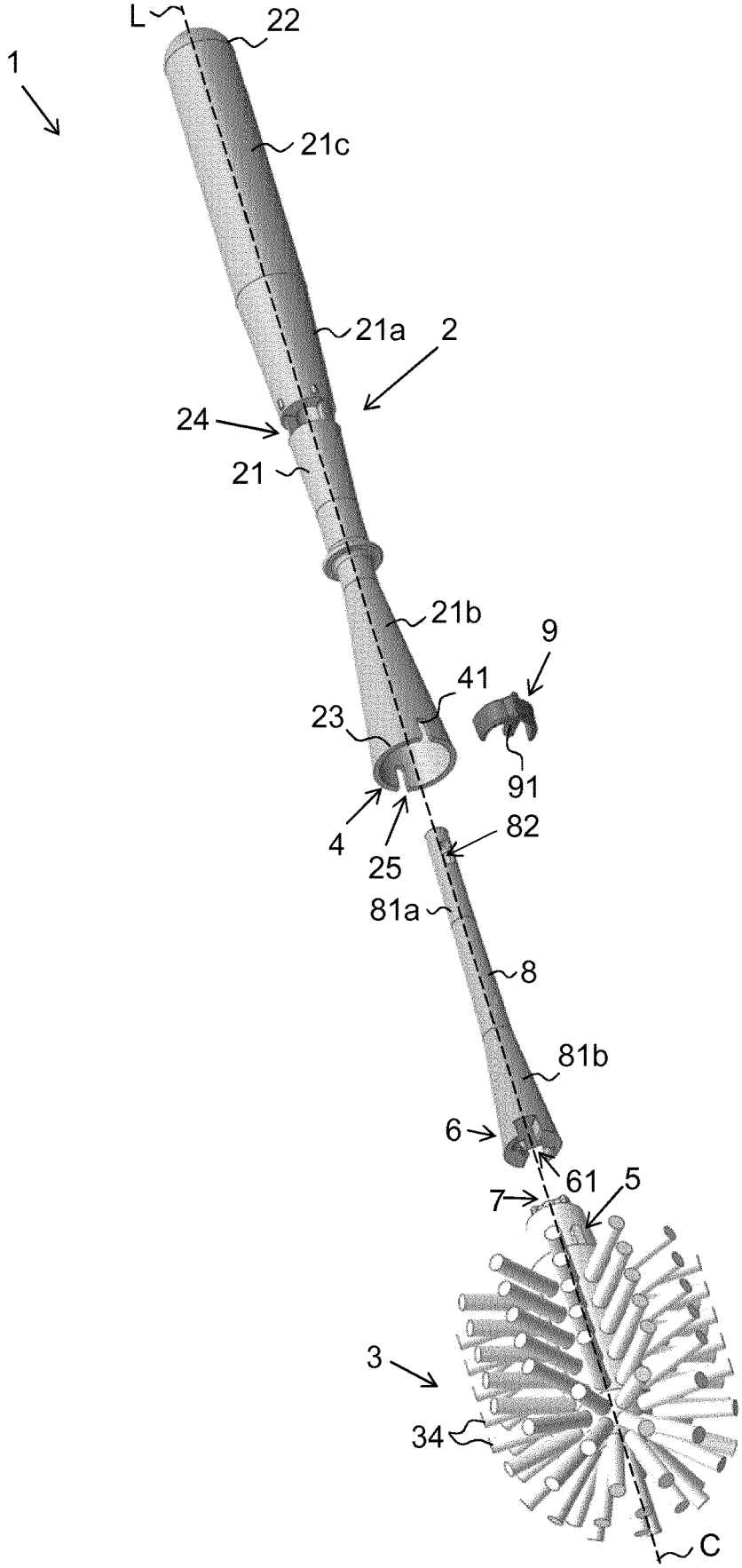
FIG. 1 shows an exploded view of a toilet brush according to a first embodiment.
Figure 2:
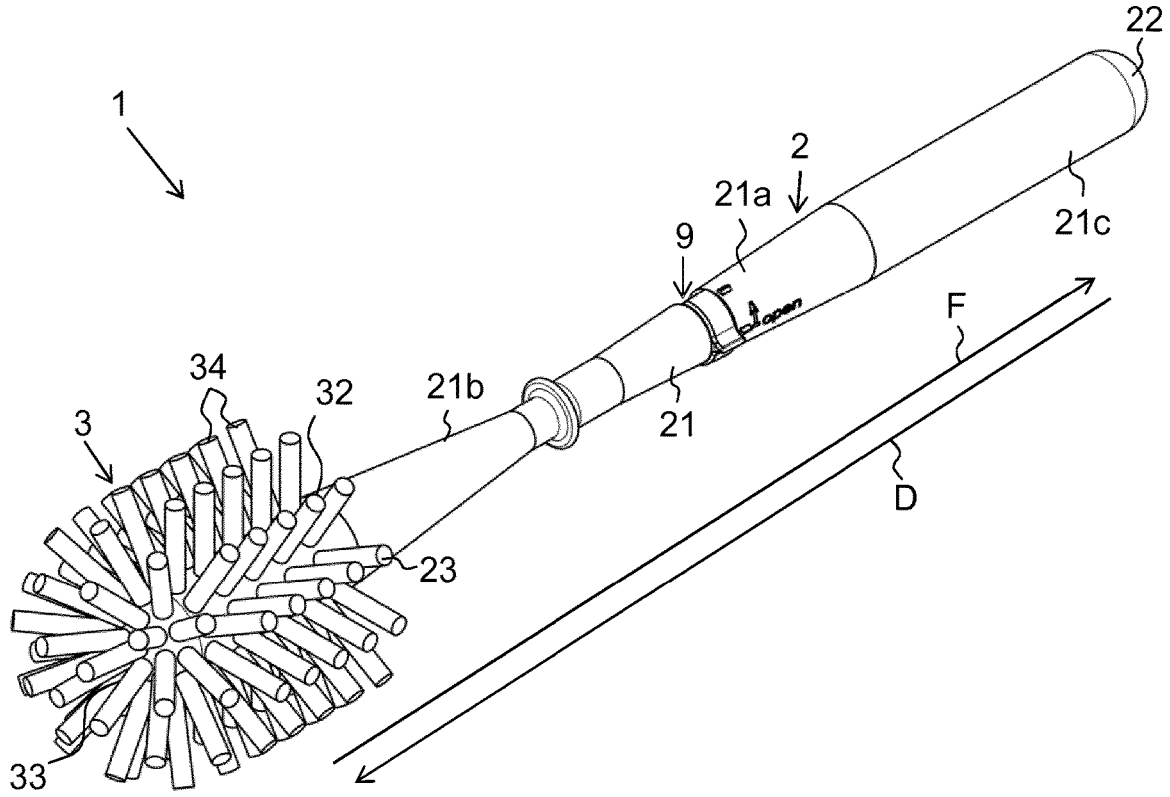
FIG. 2 shows a perspective view of the toilet brush according to FIG. 1.
Figure 3:
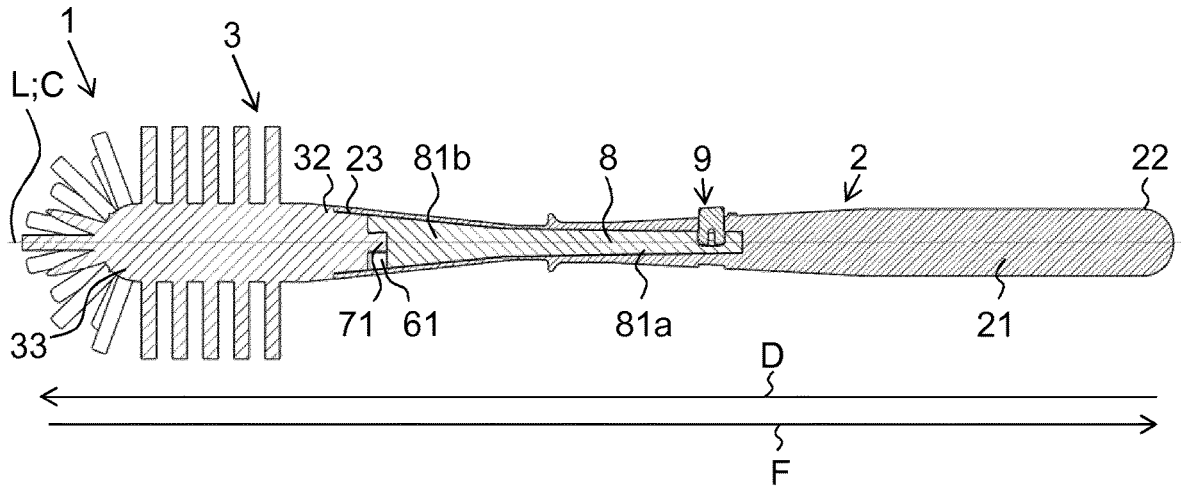
FIG. 3 shows a sectional view of the toilet brush according to FIG. 2.

A first embodiment of a toilet brush 1 is depicted in FIGS. 1 to 7*c* and a second embodiment of a toilet brush 1' is depicted in FIGS. 8 to 13*c*, respectively. In both embodiments, the toilet brush 1, 1' comprises a handle 2, 2' extending along a longitudinal axis L and having a connection structure 6, 6' as well as a brush head 3, 3' having a center axis and C having a connection structure 7, 7' being configured complementary to the connection structure 6, 6' of the handle 2, 2', such that the brush head 3, 3' and the handle 2, 2' can be releasably connected with each other by means of their respective connection structure 6, 7, 6', 7'. In the connected state, when the connection between the brush head 3, 3' and the handle 2, 2' is established, the longitudinal axis L of the handle 2, 2' and the center axis C of the brush head 3, 3' coincide. Moreover, the handle 2, 2' and the brush head 3, 3' of both embodiments in each case comprise at least one guide structure 4, 4', 5, 5', which guide structures 4, 4', 5, 5' are configured complementary to each other. These guide structures 4, 4', 5, 5' enable a connection of the brush head 3, 3' and the handle 2, 2' and a disconnection of the brush head 3, 3' from the handle 2, 2' in a guided manner. In the first embodiment, the brush head 3 comprises a plurality of bristles 34 that radially protrude from a main body 31 of the brush head 3, which in the present case has an essentially oval shape. The brush head 3' of the second embodiment has no bristles but an essentially oval, bristle-free main body. Said bristle-free main body could correspond to a sponge or a cleaning pad, for example.

Hence, it should be noted that the expression "brush head" as used herein not only refers to a brush head comprising bristles but also designates bristle-free brush heads. Moreover, it should be understood that the toilet brush according to the first embodiment can comprise a bristle-free brush head and that the toilet brush according to the second embodiment can comprise a brush head with bristles, respectively. Thus, any statements made with respect to a toilet brush comprising a brush head with bristles likewise applies to a toilet brush comprising a bristle-free brush head and vice versa.

Figure 4:
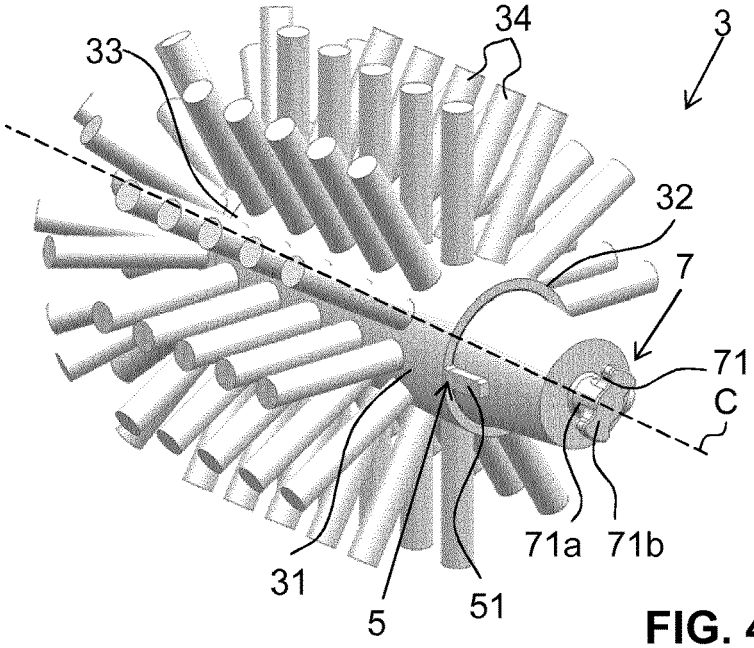
FIG. 4 shows a perspective view of a brush head of the toilet brush according to FIG. 1.
Figure 5:
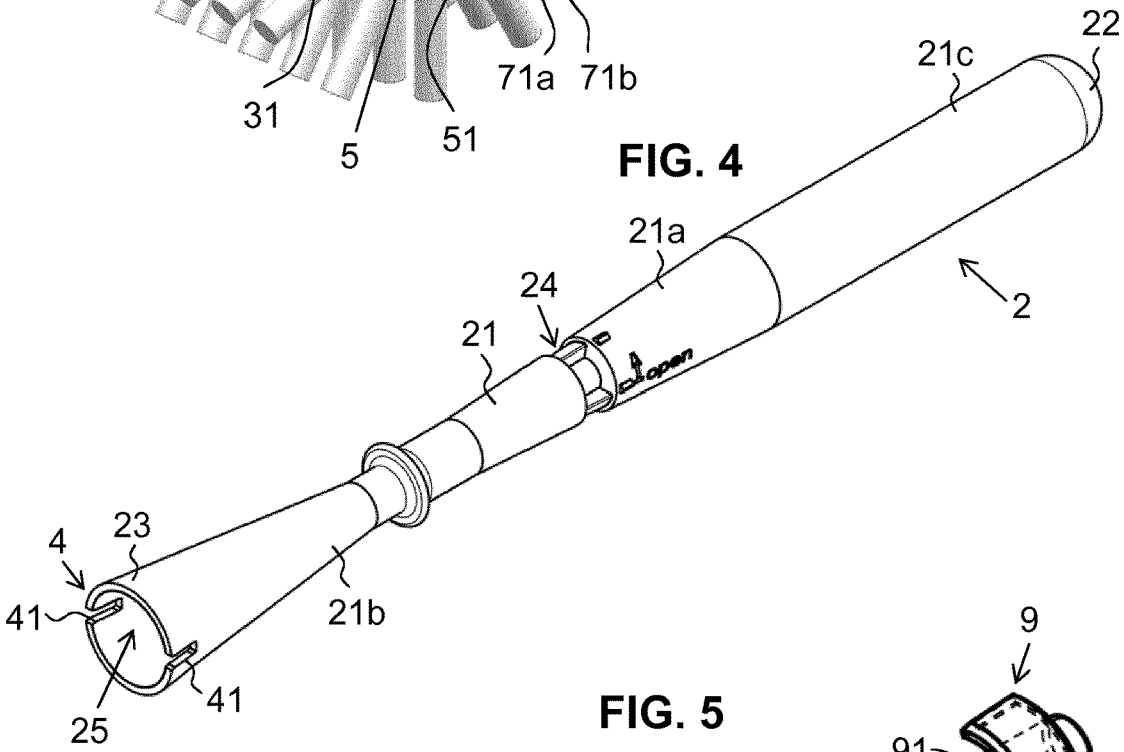
FIG. 5 shows a perspective view of a handle comprising a housing with a guide structure of the brush head according to FIG. 1.
Figure 6:
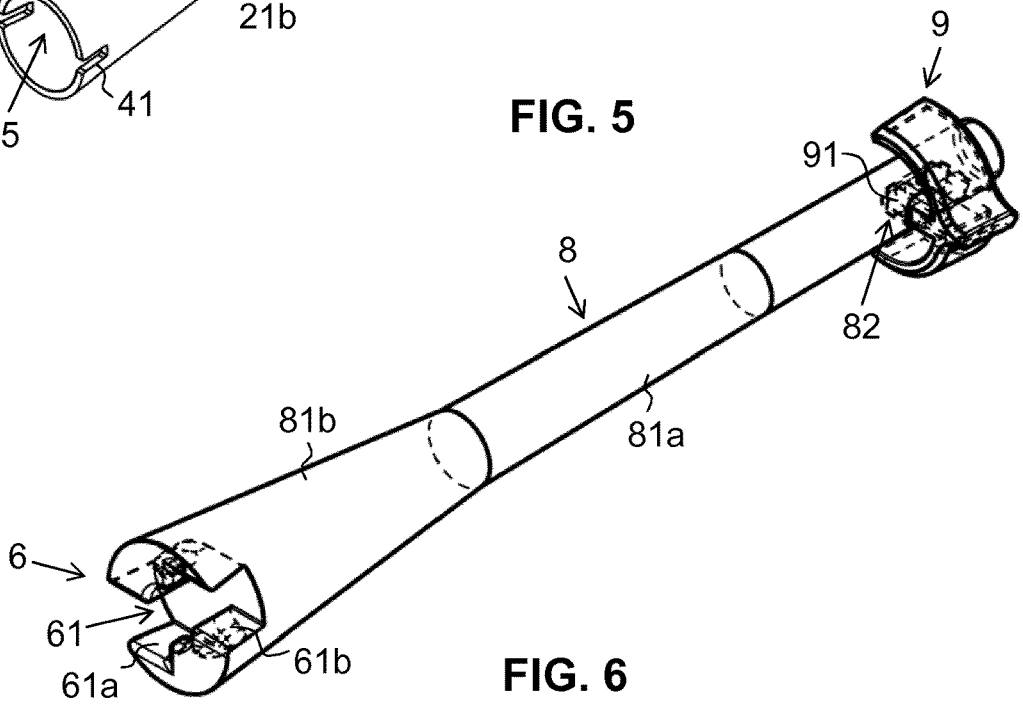
FIG. 6 shows a perspective view of an inner element comprising a connection structure and a rotary element of the toilet brush according to FIG. 1.

Aspects of the toilet brush 1 according to the first embodiment are now discussed in greater detail with reference to FIGS. 1 to 7*c*. As already mentioned, the toilet brush 1 comprises a handle 2 and a brush head 3 which can be connected with one another in a releasable manner via their corresponding connection structures 6, 7. To this end, the releasable connection can be provided by means of a bayonet mount, wherein the connection structure 6 of the handle 2 is provided by means of a recess 61 into which the connection structure 7 of the brush head 3 in the form of a protrusion 71 is inserted upon the connection of the brush head 3 and the handle 2. As best seen in FIG. 4, the protrusion 71 comprises a first section 71*a* and a second section 71*b*, wherein the first section 71*a* extends from the main body 31 of the brush head 3 along the center axis C and is of an essentially cylindrical shape. The first section 71*a* terminates in a second section 71*b* that has the form of a flange extending in a direction running transversal to the center axis C. The recess 61 on the handle in turn comprises two sections 61*a*, 61*b*, which are arranged at an angle to each other. Hence, when the brush head 3 is to be connected to the handle 2, the protrusion 71 of the head 3 is in a first step pushed into the recess 61 of the handle 2, wherein the flange 71*b* of the brush head 3 is received in the first section 61*a* of the recess 61. Once the protrusion 71, in particular the flange 71*b*, reaches the bottom of the recess 61, either the brush head 3 or the handle 2 is rotated about the center axis C of the head and the longitudinal axis L of the handle 3, respectively, whereby the flange 71*b* slides into the second section 61*b* of the recess 61. In other words, the connection structures 6, 7 provide a plug-in rotary connection. It should be noted that it is likewise conceivable to provide a recess on the connection structure of the brush head 3 and a protrusion on the connection structure of the handle 2.

In the present situation the connection structure 6 of the brush head 3 is integrally formed with the brush head 3, see FIG. 4. That is, the protrusion 71 and the main body 31 of the brush head 3 are provided in one piece, wherein the protrusion 71 is arranged stationary on the brush head 3, such that the protrusion 71 is non-rotatable about the center axis C of the brush head 3 and non-displaceable along said center axis C. It is however likewise conceivable to provide the main body 31 and the protrusion 71 as separate pieces, which are then firmly connected to one another by fastening means such as a thread or a snap-connection or a glue. Also in this case the protrusion 71 is arranged stationary and non-rotatable with respect to the main body 31 of the brush head 3.

The handle 2 comprises a housing 21, wherein the connection structure 6 of the handle 2 is provided on an inner element 8 being arranged within said housing 21. The handle housing 21 and the inner element 8 comprising the connection structure 6 are depicted separately in FIGS. 5 and 6, respectively. The inner element 8 has a first section 81*a* of an essentially cylindrical shape and constant cross-section that ends in a conically widening second section 81*b* having an increasing cross-section. The connection structure 6, i.e. the recess, is provided in the region of the free end of the conically widened inner element 81*b*. The connection structure 6 in the form of the recess is in this case an integral part of the inner element 8. Since the inner element 8 is arranged rotatable about the longitudinal axis of the handle (see below), the connection structure 6, and thus the recess 61, is therefore rotatable, too. Furthermore, since the inner element 8 is designed and arranged so as to be non-displaceable along the longitudinal axis L of the handle 2 with respect to the handle 2, the connection structure 6, and thus the recess 61, is likewise non-displaceable. As will be explained further below, a displacement of the inner element 8, in particular an unintended removal of the inner element 8 out of the handle 2, is prevented by a rotary element 9 that engages with the inner element 8, whereby the inner element 8 is fixed to the handle housing 21. The housing 21 of the handle 2 is designed in analogy to the inner element 8 and has a first section 21*a* of an essentially cylindrical shape which terminates in a second section 21*b* that is conically widening towards the distal end 23 of the housing 21 and in a third section 21*c* which is essentially cylindrical and which terminates in the proximal end 22 of the handle housing 21. Here, the inner element 8 and thus also the connection structure 6 is entirely received within the housing 21 of the handle 2, namely within the first and second sections 21*a*, 21*b* of the handle housing 21. The third section 21*c* of the housing 21 serves the purpose of a handhold for a user of the toilet brush.

Both the brush head 3 and the handle 2 further comprise guide structures 4, 5 which enable a guided connection of the brush head 3 and the handle 2 along a connection direction F and a guided disconnection of the brush head 3 from the handle 2 along a disconnection direction D running opposite to the connection direction F. The connection direction F and the disconnection direction D run parallel to the center axis C and the longitudinal axis L in the connected state of the brush head 3 and the handle 2. For this purpose the guide structure 5 of the brush head corresponds to ribs 51 provided on the main body 31 of the brush head 3 which extend along the center axis C. The handle 2, in particular the housing 21 of the handle in the region 21*b* of its free end, comprises corresponding guide structures 4 in the form of slots 41, into which the ribs 51 are increasingly received upon the connection of the handle 2 and the brush head 3. Thus, the guide structures 4, 5 provide a linear guide and in the connected state establish a form-fit. At this point it should be noted that the bayonet coupling per se already provides a linear guide during the connection of the brush head 3 and the handle 2.

Since the guide structure 4 of the handle 2 is provided on the housing 21 of the handle, said guide structure 4 is, with respect to the housing 21, non-rotatable about the longitudinal axis L of the handle 2 and non-displaceable along said longitudinal axis. Likewise, since the guide structure 5 of the brush head 3 is provided on the main body 31 of the brush head 3, said guide structure 5 is, with respect to the main body 31, non-rotatable about the center axis C of the brush head 3 and non-displaceable along said center axis C. It should be noted that it is likewise conceivable to provide slots on the brush head 3 and ribs on the housing 21 of the handle 2. Moreover, although here only two slots 41 and two ribs 51 are shown, only one or three or more ribs and slots can be provided instead.

As best seen in FIGS. 1, 3 and 7*a*-7*c*, the guide structure 4 and the connection structure 6 of the handle 2 are arranged axially offset relative to each other with respect to the longitudinal axis L of the handle 2 and are arranged radially spaced apart from one another with respect to the longitudinal axis L of the handle 2. The guide structure 5 and the connection structure 7 of the brush head 3 are arranged axially offset relative to each other with respect to the center axis C of the brush head 3 and are arranged radially spaced apart from one another with respect to the center axis C of the brush head, see FIG. 4. In other words, when viewing from the distal end 23 of the handle 2 towards the proximal end 22 of the handle 2 along the longitudinal axis L of the handle 2, the slots 41 are arranged before the recess 61 and the slots 41 are arranged offset to the outside of the handle 2. In the case of the brush head 3, when viewing from a proximal end 32 of the brush head 3 towards a distal end 33 of the brush head 3 along the center axis C of the brush head 3, the protrusion 71 is arranged before the ribs 51 and the ribs 51 are arranged to the outside of the brush head 3 with respect to the ribs 51. Due to this arrangement, upon the connection of the brush head 3 and the handle 2, a contact between the guide structures 4, 5 of the handle 2 and the brush head 3 is established prior to a contact being established between the connection structures 6, 7 of the handle 2 and the brush head 3. Upon the detachment of the brush head 3 from the handle 2, the contact established between the guide structures 4, 5 of the handle 2 and the brush head 3 is released after the contact being established between the connection structures 6, 7 of the handle 2 and the brush head 3 is released. The guide structures 4, 5 of the handle 2 and the brush head 3 therefore initially center or align the brush head 3 and the handle 2 with respect to each other and subsequently provide a linear guidance upon their further connection. Thereby the risk of an unintended tilting of the brush head 3 relative to the handle 2 is minimized or even avoided and a more stable, secure and thus reliable connection of the brush head 3 and the handle 2 is provided. When the brush head 3 is to be released from the handle 2, the connection established between the connection structures 6, 7 of the handle 2 and the brush head 3 is initially released. Subsequently, the guide structures 4, 5 guide the removal of the brush head 3 from the handle 2 such that a disposal of the brush head 3 in a waste bin, for example, can be carried out in a targeted and contactless manner.

The toilet brush 1 further comprises a rotary element 9 which is rotatably mounted on the handle 2. A rotation of the rotary element 9 by a user about the longitudinal axis L of the handle 2 results in a rotation of the connection structure 6 of the handle 2. That is, if a user wishes to dispose the brush head 3 from the toilet brush 1, he simply has to actuate the rotary element 9 and the brush head 3 will be disconnected from the handle 2. Thereby, the rotation of the rotary element 9 results in a release of the bayonet connection 7, 6 established between the brush head 3 and the handle 2. Once said connection between the brush head 3 and the handle 2 is released, the brush head 3 slides by means of its ribs 51 out of the slots 41 of the handle 2. During the rotation of the rotary element 9 the housing 21 of the handle 2 and thus also the connection structure 41 formed thereon do not rotate, but only the inner element 8. On the other hand, if a new brush head 3 is to be connected to the handle 2, the ribs 51 of the new brush head 3 slide into the slots 41 of the handle 2 until the protrusion 71 of the brush head 3 reaches the bottom of the recess 61 of the handle 2. Then, the rotary element 9 is rotated about the longitudinal axis L of the handle 2, whereby the bayonet coupling 7, 6 between the brush head 3 and the handle 2 is established. The rotary motion a user exerts on the rotary element 9 in order to attach the brush head 3 is opposite to the rotary motion the user exerts on the rotary element 9 in order to detach the brush head 3 from the handle 2. The rotary element 9 and the connection structure 6 of the handle 2 as well as the rotary element 9 and the guide structure 4 of the handle 2 are arranged axially offset relative to each other with respect to the longitudinal axis L of the handle 2. In addition, the rotary element 9 is arranged radially spaced apart from the inner element 8 of the handle 2. In other words, when viewing from the distal end 23 of the handle 2 towards the proximal end 22 of the handle 2 along the longitudinal axis L of the handle 2, the connection structure 6 and the guide structure 4 are arranged before the rotary element 9. In addition, the rotary element 9 is arranged towards the outside with respect to the inner element 8 of the handle 2.

As best seen in FIG. 1, the rotary element 9 and the connection structure 6 of the handle 2 as well as the rotary element 9 and the guide structure 4 of the handle 2 are designed as separate components, which separate components are fastened to one another by means of a corresponding fastening structure.

In particular, the rotary element 9 is mounted on an outside of the handle 2 and is in connection with the inner element 8 comprising the connection structure 6 via an opening 24 in the housing 21 of the handle 2. The rotary element 9 has the shape of a clip or bracket, which on the one side is configured to clasp the essentially cylindrical first section 21*a* of the inner element 8 and on the other side comprises a fastening structure 91, here a protruding pin, that is configured to snap into a corresponding recess 82 provided on the first section 81*a* of the inner element 8. That is to say, the rotary element 9 is connected to the inner element 8 by means of a latching connection 91, 82. In this way the inner element 8 is fastened rotatably but axially non-displaceably to the housing 21 of the handle 2. It should be noted that the rotary element 9 does not have to be configured as a clip or bracket that at least partially encloses the inner element 8. Instead, the rotary element 9 could also be provided in the form of a simple protrusion that is operatively connected to the inner element 8, such that a rotation of the rotary element 9 is transferred to the inner element 8, and which is graspable by a user. Moreover, it is likewise conceivable that the rotary element 9 and the inner element 8 are provided as a single-piece element. In any case, the rotary element 9 is mounted rotatably but non-displaceably on the handle 2.

Figure 7A:
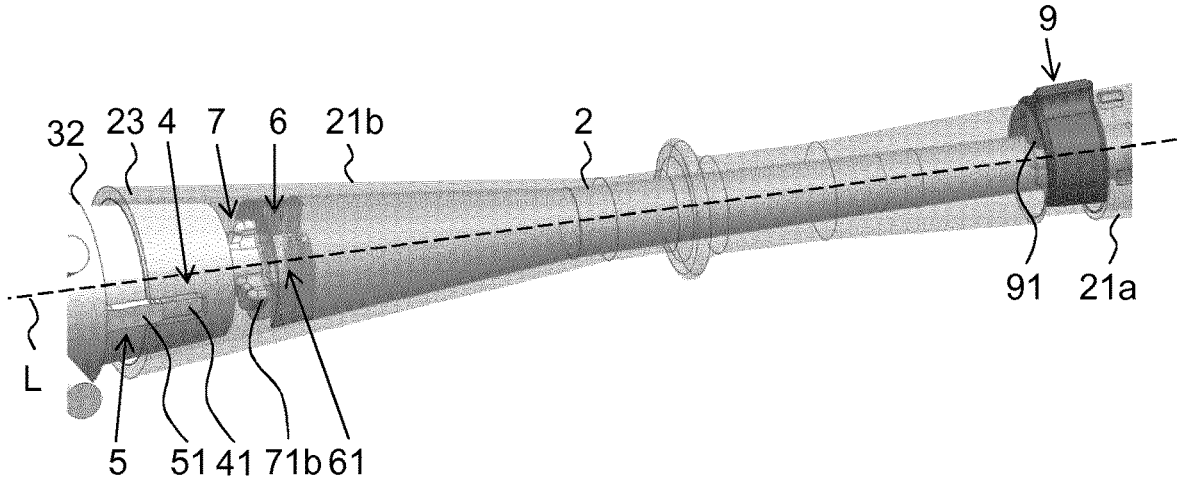
FIG. 7*a* shows a sectional perspective view of a brush head and a handle of the toilet brush according to FIG. 1 in an unconnected state.
Figure 7B:
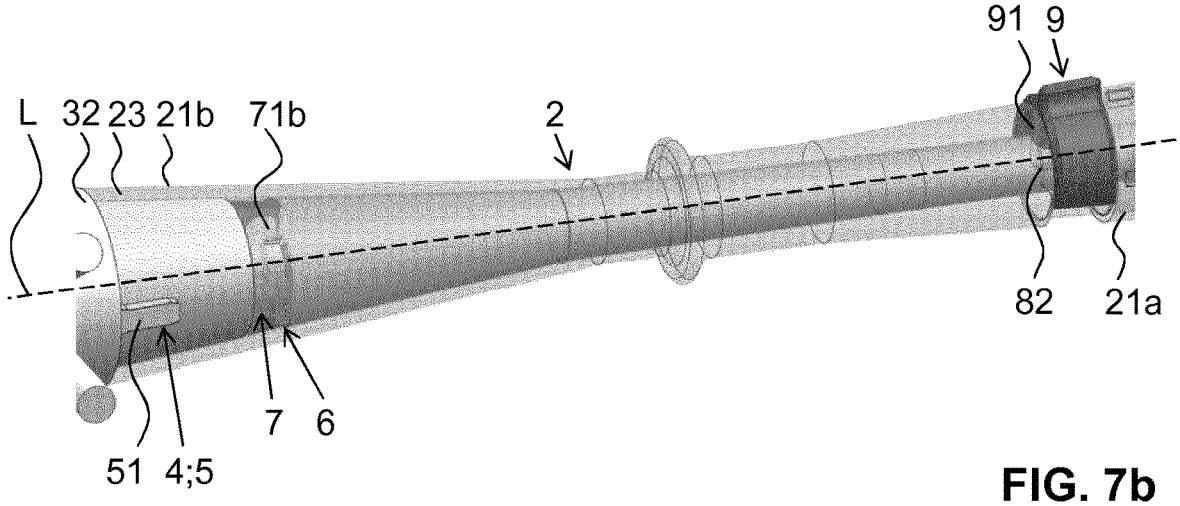
FIG. 7*b* shows a sectional perspective view of the brush head and the handle of the toilet brush according to FIG. 1 in a semi-connected state.
Figure 7C:
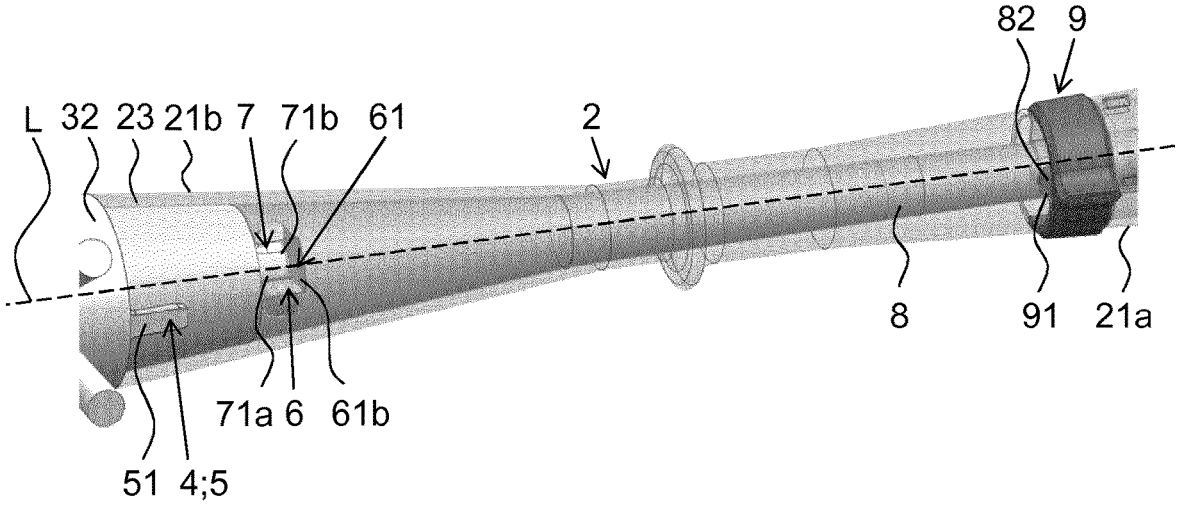
FIG. 7*c* shows a sectional perspective view of the brush head and the handle of the toilet brush according to FIG. 1 in a connected state.

The guided connection of a brush head 3 to the handle 2 is now explained in greater detail with reference to FIGS. 7*a* to 7*c*. In a first step the brush head 3 is introduced into an opening 25 defined by the handle 2 housing 21, wherein the ribs 51 of the brush head 3 at least partially slide into the slots 41 of the handle housing 21. At this time the connection structure 7 in the form of the protrusion 71 on the brush head 3 is not yet in contact with the connection structure 6 in the form of the recess 61 on the handle 2. In this position the brush head 3 is radially and tangentially fixed with respect to the fixed handle 2 (see FIG. 7*a*). In a second step, the brush head 3 is further pushed into the handle 2 in a linear movement, wherein the ribs 51 of the brush head 3 are continuously received within the slots 41 of the handle 2 until the protrusion 71 of the brush head 3 reaches the bottom end of the recess 61 of the handle 2. In this position the brush head 3 is defined in an axial direction, i.e. defined with respect to the longitudinal axis L of the handle 2, but not yet fixed within the handle 2 (see FIG. 7*b*). In a third step, the rotary element 9 is turn about the longitudinal axis L of the handle 2 from an opening position into a closing position. The rotation of the rotary element 9 is transferred to the inner element 8 and thus to the connection structure 6 of the handle 2, whereby the protrusion 71, in particular its flange 71*b*, of the brush head 3 is fixedly received in the recess 61 of the handle 2, i.e. the bayonet-coupling is established (see FIG. 7*c*). In order to disconnect the brush head 3 from the handle 2 the above steps 7*a* to 7*c* are carried out in the reverse order.

Figure 8:
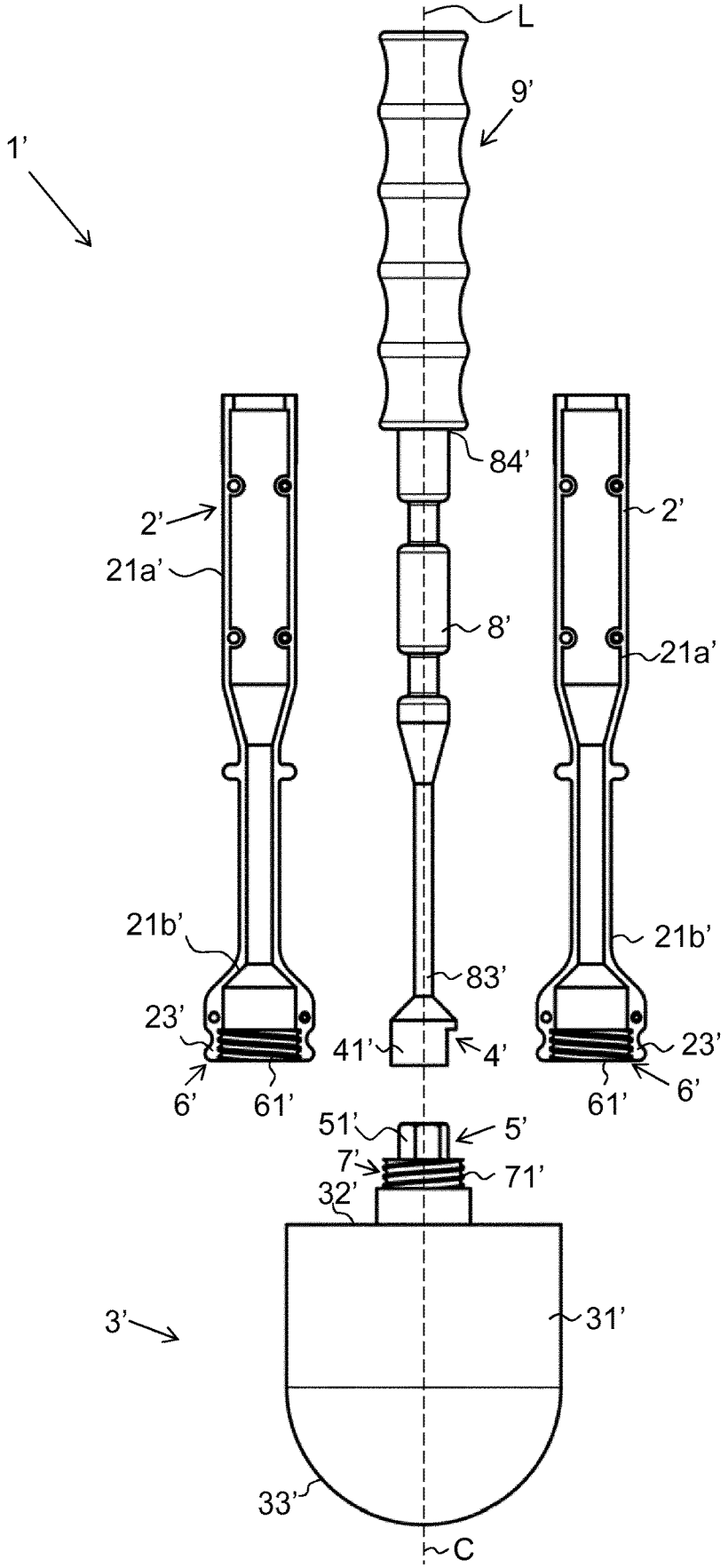
FIG. 8 shows an exploded view of a toilet brush according to a second embodiment.
Figure 9:
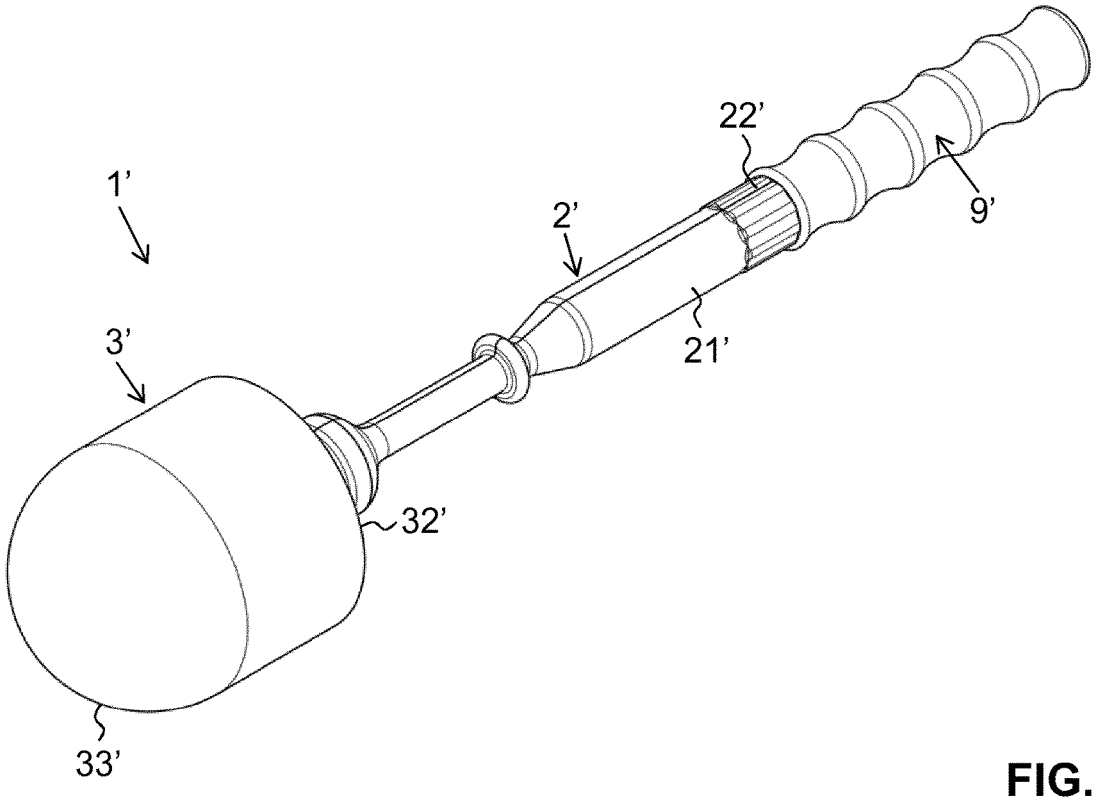
FIG. 9 shows a perspective view of the toilet brush according to FIG. 8.

In the following, aspects of the toilet brush 1' according to the second embodiment will be explained in greater detail with respect to FIGS. 8 to 13*c*. As best seen in FIG. 8, said toilet brush 1' comprises a handle 2' which has a handle housing 21', within which an inner element 8' is mounted. In the present case the handle housing 21' is built from two housing halves which can be connected with each other so as to form a common housing 21'. This is mainly due to production engineering reasons. Said two housing halves are connected to each other by means of a plug connection, wherein protruding pins provided on one housing halve are introduced into corresponding recesses provided on the other housing halve. In contrast to the first embodiment, the handle housing 21' comprises the connection structure 6' configured to establish a connection with the corresponding connection structure 7' of the brush head 3' and the inner element 8' comprises the guide structure 4' configured to provide guidance together with the corresponding guide structure 5' of the brush head 3'. The inner element 8' has a shape that is essentially complementary to the shape of the interior of the housing 21', such that an axial displacement of the inner element 8' within the housing 21' is prevented by the complementary design. The connection structure 6' of the handle 2' corresponds to an inner thread 61' provided on the distal end 23' of the handle housing 21'. Upon connection of the brush head 3' and the handle 2', said inner thread 61' establishes a threaded connection with a corresponding outer thread 71' provided on a proximal end region 32' of the brush head 3'. The guide structure 4' of the handle 2' is provided on a distal end 83' of the inner element 8' and in this case corresponds to an essentially hexagonal socket 41' that is configured to be plugged over a corresponding hexagon plug 51' provided proximally from the connection structure 7' of the brush head 3'. Upon the connection of the brush head 3' with the handle 2', the hexagon plug 51' is guidingly received within the hexagon socket 41'. It should be noted that the shapes of the guide structures 4', 5' need not be restricted to a hexagonal shape. Instead, any shapes are conceivable, which have lateral surfaces that can slide along each other and which thereby provide a linear guide. As will be explained further below, it is particularly preferred that the shapes of the guide structures 4', 5' are configured such that they enter into engagement with each other and establish a form-fit and/or a force-fit in the connected state, such that a rotation of the brush head 3' is transferred to the handle 2', in particular to the inner element 8', and vice versa.

Figure 10:
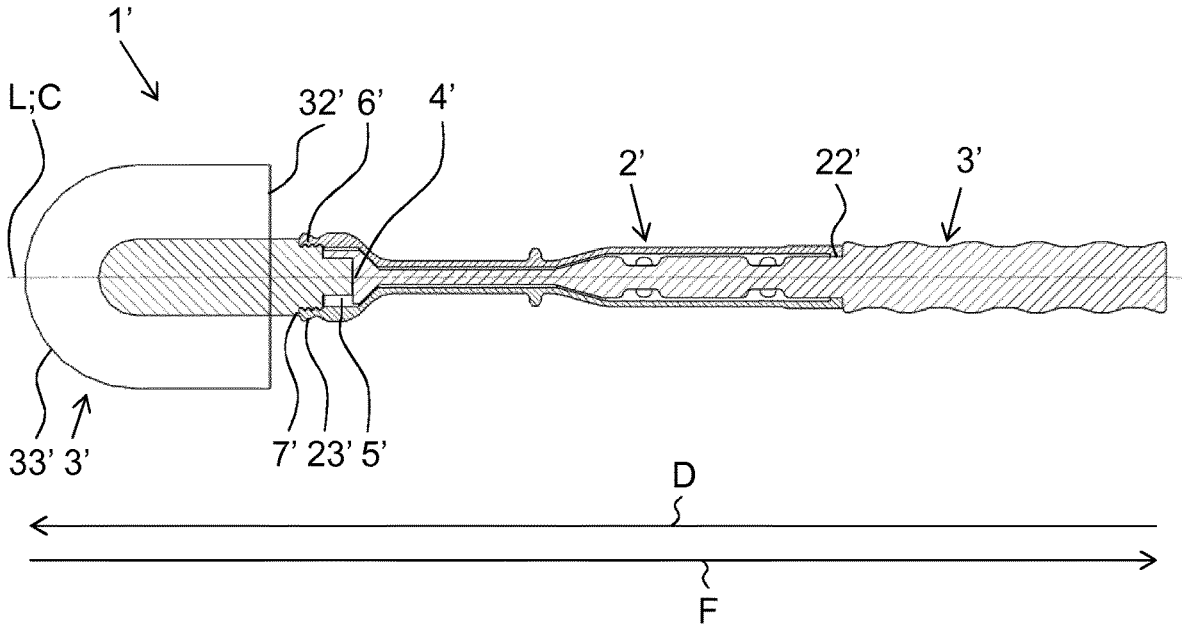
FIG. 10 shows a sectional view of the toilet brush according to FIG. 9.
Figure 11:
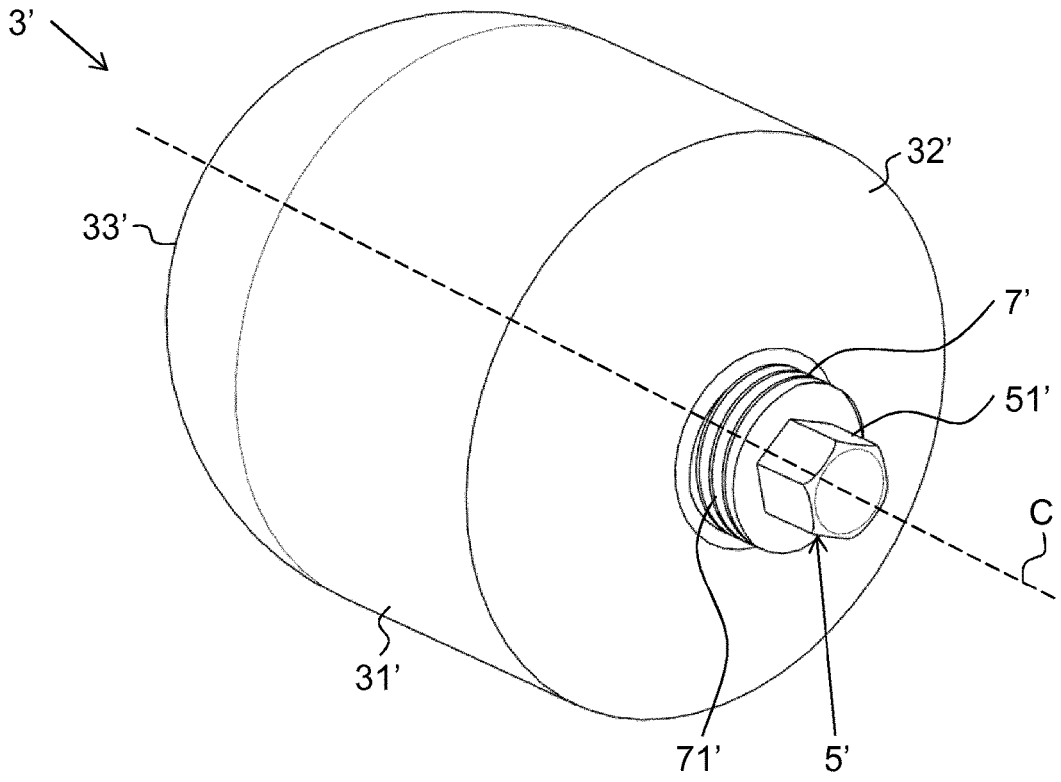
FIG. 11 shows a perspective view of a brush head of the toilet brush according to FIG. 8.
Figure 12:
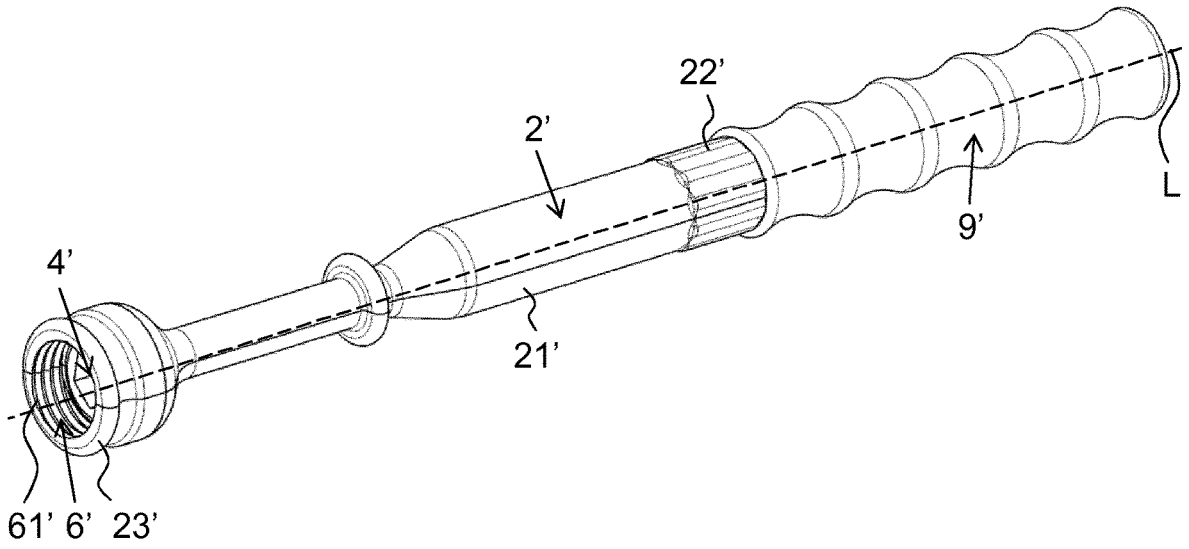
FIG. 12 shows a perspective view of a handle of the toilet brush according to FIG. 8.

To this end and as follows from FIG. 10 the guide structure 4' and the connection structure 6' of the handle 2' are arranged axially offset relative to each other and radially spaced apart from one another with respect to the longitudinal axis L of the handle 2'. That is to say, when viewing from the distal end 23' of the handle 2' towards the proximal end 22' of the handle 2' along the longitudinal axis L of the handle 2', the inner thread 61' is arranged before the socket 41' and is arranged offset to the outside of the handle 2'. Or in other words, the socket 41' is offset inwards towards an interior of the handle housing 21'. Here, the inner thread 61' forms part of the handle housing 21' and the socket 41' is entirely received within the handle housing 21'.

The guide structure 5' and the connection structure 7' of the brush head 3' are arranged axially offset relative to each other and are arranged radially spaced apart from one another with respect to the center axis C of the brush head 3'. Hence, when viewing from the proximal end 32' of the brush head 3' towards the distal end 33' of the brush head along the center axis C of the brush head 3', the plug 51' is arranged before the outer thread 71' and the outer thread 71' is arranged to the outside with respect to the plug 51', see FIG. 11. Due to this arrangement, upon the connection of the brush head 3' and the handle 2', a contact between the guide structures 4', 5' of the handle 2' and the brush head 3' is established prior to a contact being established between the connection structures 6', 7' of the handle 2' and the brush head 3'. Upon the detachment of the brush head 3' from the handle 2', the contact established between the guide structures 4', 5' of the handle 2' and the brush head 3' is released after the contact established between the connection structures 6', 7' of the handle 2' and the brush head 3' is released.

Here, the connection structure 6' of the handle 2' is non-rotatable about the longitudinal axis L of the handle 2' and non-displaceable along said longitudinal axis L with respect to the handle housing 21'. The guide structure 4' of the handle 2' is non-displaceable along the longitudinal axis L of the handle 2' but however is rotatable about the longitudinal axis L of the handle 2' with respect to the handle housing 21'. In the present situation the connection structure 7' and the guide structure 5' are integrally formed with the brush head 3'. That is, the external thread 71', the plug 51' and the main body 31' of the brush head 3' are provided in one piece, wherein the external thread 71' and the plug 51' are arranged stationary on the brush head 3', such that these components are non-rotatable about the center axis C of the brush head 3' and non-displaceable along said center axis C with respect to the brush head 3'. It is however likewise conceivable to provide the main body 31' and the external thread 71' and/or the plug 51' as separate pieces, which are then firmly connected to one another by fastening means such as a snap-connection or a glue. Thus, the connection structure 7' of the brush head is non-rotatable about the center axis C of the brush head 3' and non-displaceable along said center axis C with respect to the brush head 3'. Moreover, the guide structure 5' of the brush head 3' is non-rotatable about the center axis C of the brush head 3' and non-displaceable along said center axis C with respect to the brush head 3'.

Here too it should be noted that it is likewise conceivable to provide the connection structure in the form of an inner thread and the guide structure on the form of a socket on the brush head and the connection structure in the form of an outer thread and the guide structure in the form of a plug on the handle.

The toilet brush 1' according to the second embodiment also comprises a rotary element 9' which is rotatably mounted on the handle 2'. As best seen in FIGS. 8 to 10 and 12, said rotary element 9' corresponds to a grip, which is in connection with the guide structure 4' and which distally protrudes from the handle housing 21'. In particular, the grip 9' and the inner element 8' comprising the guide structure 4' are provided as one component, preferably as a single-piece element. It is also conceivable that this component is comprised of separate elements, wherein the guide structure 4' is fastened to the inner element 8' and/or the grip 9' is fastened to the inner element 8' by means of conventional fastening means. In any case, the grip 9' is mounted axially non-displaceably with respect to the handle housing 21'. A rotation of the rotary element 9' by a user about the longitudinal axis L of the handle 2' thus results in a rotation of the inner element 8' and therefore of the guide structure 4' of the handle. Due to the form-fit established between the guide structures 4', 5' of the handle 2' and the brush head 3', the rotation of the guide structure 4' of the handle 2' is transferred to the guide structure 5' of the brush head 3', which in turn results in a rotation of the entire brush head 3', whereby the threaded connection between the connection structures 71', 61' of the brush head 3' and the handle 2' is successively released. Once the connection between the brush head 3' and the handle 2' is released, the brush head 3' slides by means of its plug 51' out of the socket 41' of the handle 2'. On the other hand, if a new brush head 3' is to be connected to the handle 2', the plug 51' of the new brush head 3' slides into the socket 41' of the handle 2'. Then, the rotary element 9' is rotated about the longitudinal axis L of the handle 2', whereby the threaded connection between the brush head 3' and the handle 2' is established. Again, the rotary motion exerted on the rotary element 9' by a user in order to attach the brush head 3' is opposite to the rotary motion the user exerts on the rotary element 9' in order to detach the brush head 3' from the handle 2'. The rotary element 9' and the connection structure 6' as well as the rotary element 9' and the guide structure 4' of the handle 2' are arranged axially offset relative to each other with respect to the longitudinal axis L of the handle 2'. That is, when viewing from the distal end 23' of the handle 2' towards the proximal end 22' of the handle 2' along the longitudinal axis L of the handle 2', the connection structure 6' and the guide structure 4' are arranged before the rotary element 9'.

Figure 13A:
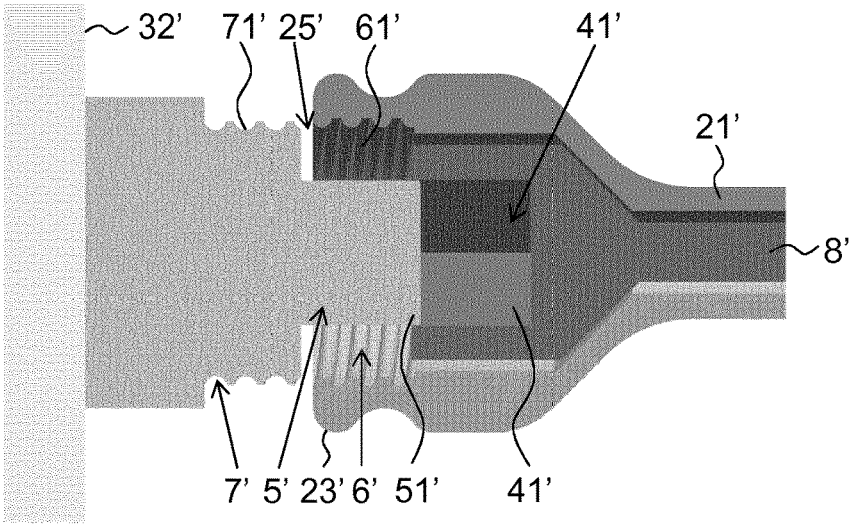
FIG. 13*a* shows a sectional perspective view of a brush head and a handle of the toilet brush according to FIG. 8 in an unconnected state.
Figure 13B:
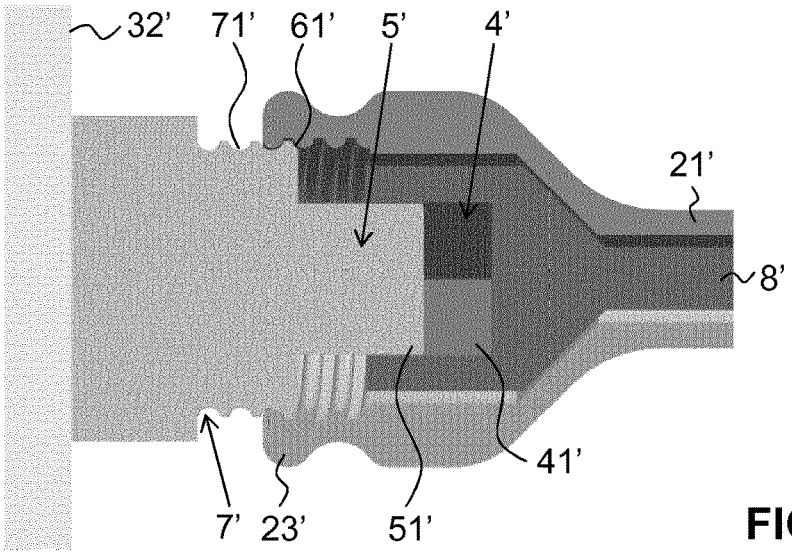
FIG. 13*b* shows a sectional perspective view of the brush head and the handle of the toilet brush according to FIG. 8 in a semi-connected state.
Figure 13C:
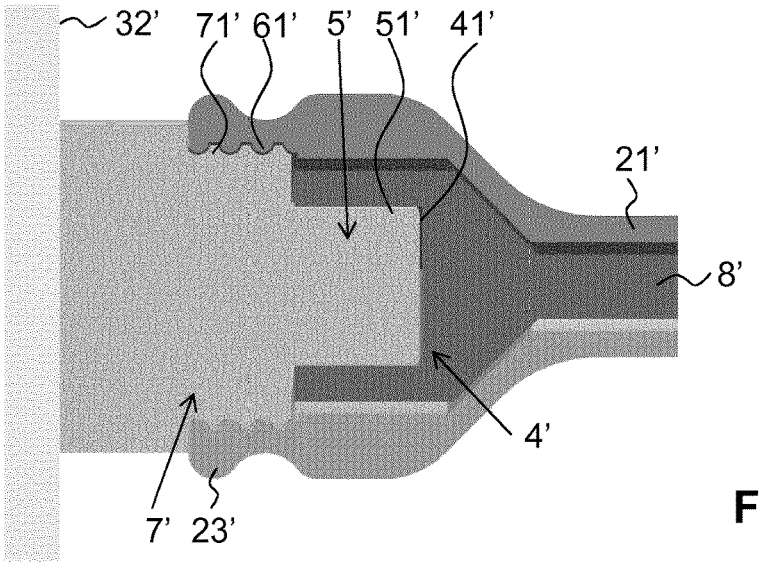
FIG. 13*c* shows a sectional perspective view of the brush head and the handle of the toilet brush according to FIG. 8 in a connected state.

The guided connection of a brush head 3' to the handle 2' is now explained in greater detail with reference to FIGS. 13*a* to 13*c*. In a first step the brush head 3' is introduced into the opening 25' of the handle 2', wherein the plug 51' of the brush head 3' at least partially slides into the socket 41' of the handle housing 21'. At this time the connection structure in the form of the outer thread 71' on the brush head 3' is not yet in contact with the connection structure 61' in the form of the inner thread on the handle 2'. In this position the brush head 3' is radially and tangentially fixed with respect to the fixed handle 2' (see FIG. 13*a*). In a second step, the brush head 3' is further pushed into the handle 2' in a linear movement, wherein the plug 51' of the brush head 3' is continuously received within the socket 41' of the handle 2', whereby a first contact is established between the connection structures 61', 71' of the handle 2' and the brush head 3'. In this position the brush head 3' is defined in an axial direction, i.e. defined with respect to the longitudinal axis L of the handle 2', but not yet fixed within the handle 2' (see FIG.

13*b*). In a third step, the rotary element 9 is turn about the longitudinal axis L of the handle 2' from an opening position into a closing position. The rotation of the rotary element 9' is transferred to the inner element 8' and thus to the guide structure 4' of the handle 2'. Due to the form-fit established between the plug 51' and the socket 41' of the brush head 3' and the handle 2', the rotation is further transferred via the plug 51' to the brush head 3' and the threaded connection is established (see FIG. 13*c*). In order to disconnect the brush head 3' from the handle 2' the above steps 13*a* to 13*c* are carried out in the reverse order.

Hence, also in the case of the toilet brush 1' according to the second embodiment the guide structures 4', 5' minimize or even avoid the risk of an unintended tilting of the brush head 3' relative to the handle 2' and a more stable, secure and thus reliable connection of the brush head 3' and the handle 2' is provided. When the brush head 3' is to be released from the handle 2', the connection established between the connection structures 6', 7' of the handle 2' and the brush head 3' is initially released. Subsequently, the guide structures 4', 5' guide the removal from the brush head 3' from the handle 2' such that a disposal of the brush head 3' in the waste bin, for example, can be carried out in a targeted and contactless manner.

Conceivable materials for the toilet brush 1, 1' are materials known in the field. For example, the handle 2, 2' and the brush head 3, 3' can be made of plastics. For example, they can be made of polypropylene, polyurethane, polyester, polyether, ethylene-vinyl acetate or silicone. Other conceivable materials are natural sponges or synthetic sponges such as viscose sponges or natural or synthetic rubber. However, also natural components such as fibers, argenga, palmyra or coconut as well as mixtures from synthetic and natural components are possible. Moreover, it is possible to provide a handle 2, 2' or a brush head 3, 3' made of plastics in combination with steel, wood, ceramic or stone.

The invention claimed is:

1. A toilet brush for cleaning a toilet bowl, the toilet brush comprising:

a handle extending along a longitudinal axis and having a first connection structure, and a brush head having a center axis and having a second connection structure being configured complementary to the first connection structure of the handle, wherein the brush head and the handle are releasably connectable with each other by the first connection structure and the second connection structure, wherein the handle further comprises at least one first guide structure and the brush head further comprises at least one second guide structure being configured complementary to the at least one first guide structure of the handle, such that the brush head and the handle are connectable to one another and disconnectable from one another in a guided manner, wherein the first connection structure of the handle and the second connection structure of the brush head establish, in a connected state, a rotary connection or a plug-in rotary connection, and wherein the at least one second guide structure and the second connection structure of the brush head are arranged axially offset and axially spaced apart relative to each other with respect to the center axis of the brush head, and wherein the toilet brush further comprises a rotary element which is rotatably mounted on the handle, and wherein the rotary element is designed and arranged such that a rotation of the rotary element results in a release of the connection between the brush head and the handle.

2. The toilet brush according to claim 1, wherein the first connection structure of the handle is designed to be rotatable about the longitudinal axis of the handle and to be non-displaceable along said longitudinal axis, or wherein the first connection structure of the handle is designed to be non-rotatable about the longitudinal axis of the handle and to be non-displaceable along said longitudinal axis.

3. The toilet brush according to claim 1, wherein the second connection structure of the brush head is designed to be non-rotatable about the center axis of the brush head and to be non-displaceable along said center axis.

4. The toilet brush according to claim 3, wherein at least one of: the second connection structure and the brush head are formed in one piece or the second connection structure is fixedly connected to the brush head.

5. The toilet brush according to claim 1, wherein the at least one first guide structure of the handle is designed to be rotatable about the longitudinal axis of the handle and to be non-displaceable along said longitudinal axis; or wherein the at least one first guide structure of the handle is designed to be non-rotatable about the longitudinal axis of the handle and to be non-displaceable along said longitudinal axis.

6. The toilet brush according to claim 1, wherein the at least one second guide structure of the brush head is designed to be non-rotatable about the center axis of the brush head and to be non-displaceable along said center axis.

7. The toilet brush according to claim 6, wherein at least one of: the at least one second guide structure and the brush head are formed in one piece or the second guide structure is fixedly connected to the brush head.

8. The toilet brush according to claim 1, wherein the at least one first guide structure and the first connection structure of the handle are arranged axially offset relative to each other with respect to the longitudinal axis of the handle.

9. The toilet brush according to claim 1, wherein at least one of:

i) wherein the at least one first guide structure and the first connection structure of the handle are arranged radially spaced apart from one another with respect to the longitudinal axis of the handle, or ii) wherein the at least one second guide structure and the second connection structure of the brush head are arranged radially spaced apart from one another with respect to the center axis of the brush head.

10. The toilet brush according to claim 1, wherein the at least one first guide structure of the handle and the at least one second guide structure of the brush head establish, in a connected state, at least one of a form-fit or a force-fit.

11. The toilet brush according to claim 1, wherein the handle comprises a housing, and wherein at least one of the first connection structure of the handle is arranged within the housing or wherein the at least one first guide structure of the handle forms part of the housing; or wherein at least one of the first connection structure of the handle forms part of the housing or wherein the at least one first guide structure is arranged within the housing.

12. The toilet brush according to claim 11, wherein the first connection structure of the handle is arranged entirely within the housing.

13. The toilet brush according to claim 11, wherein the at least one first guide structure is arranged entirely within the housing.

14. The toilet brush according to claim 1, wherein a rotation of the rotary element about the longitudinal axis of the handle results in a rotation of the at least one first guide structure of the handle; or wherein a rotation of the rotary element about the longitudinal axis of the handle results in a rotation of the first connection structure of the handle.

15. The toilet brush according to claim 14, wherein at least one of:

i) wherein at least one of the rotary element and the first connection structure of the handle are arranged axially offset relative to each other with respect to the longitudinal axis of the handle or wherein the rotary element and the at least one first guide structure of the handle are arranged axially offset relative to each other with respect to the longitudinal axis of the handle, or ii) wherein at least one of the rotary element and the first connection structure of the handle are arranged radially spaced apart from one another with respect to the longitudinal axis of the handle or wherein the rotary element and the at least one first guide structure of the handle are arranged radially spaced from one another with respect to the longitudinal axis of the handle.

16. The toilet brush according to claim 14, wherein at least one of the rotary element and the first connection structure of the handle or the at least one first guide structure of the handle are designed as separate components and which separate components are fastened to one another by a corresponding fastening structure, or wherein at least one of the rotary element and the first connection structure of the handle or the at least one first guide structure of the handle are designed as a single-piece component.

17. The toilet brush according to claim 14, wherein the rotary element is mounted on an outside of the handle and is in connection with at least one of the first connection structure of the handle or with the at least one first guide structure of the handle arranged in an interior of the handle or with the first connection structure of the handle arranged in the interior of the handle.

18. The toilet brush according to claim 1, wherein the first connection structure of the handle and the second connection structure of the brush head establish, in a connected state, a threaded connection or a bayonet connection.

19. The toilet brush according to claim 1, wherein the first guide structure of the handle has a protruding design when seen along the longitudinal axis and which is receivable in the second guide structure in the form of a corresponding recess provided on the brush head, or wherein the second guide structure of the brush head has a protruding design when seen along the center axis and which is receivable in the first guide structure in the form of a corresponding recess provided on the handle.

20. A toilet brush for cleaning a toilet bowl, the toilet brush comprising:

a handle extending along a longitudinal axis and having a first connection structure, and a brush head having a center axis and having a second connection structure being configured complementary to the first connection structure of the handle, wherein the brush head and the handle are releasably connectable with each other by the first connection structure and the second connection structure, wherein the handle further comprises at least one first guide structure and the brush head further comprises at least one second guide structure being configured complementary to the at least one first guide structure of the handle, such that the brush head and the handle are connectable to one another and disconnectable from one another in a guided manner, and wherein the first connection structure of the handle and the second connection structure of the brush head establish, in a connected state, a rotary connection or a plug-in rotary connection, and wherein the at least one second guide structure and the second connection structure of the brush head are arranged axially offset and axially spaced apart relative to each other with respect to the center axis of the brush head, and wherein the toilet brush further comprises a rotary element which is rotatably mounted on the handle, and wherein the rotary element is designed and arranged such that a rotation of the rotary element results in a release of the connection between the brush head and the handle, and wherein the at least one first guide structure of the handle and the at least one second guide structure of the brush head are configured such, that upon the connection of the brush head and the handle, a connection between the at least one first guide structure of the handle and the at least one second guide structure of the brush head is established prior to a connection being established between the first connection structure of the handle and the second connection structure of the brush head, and that upon the detachment of the brush head from the handle, the connection established between the at least one first guide structure of the handle and the at least one second guide structure of the brush head is released after the connection established between the first connection structure of the handle and the second connection structure of the brush head is released.

* * * * *